US009362647B2

(12) United States Patent
Omae et al.

(10) Patent No.: US 9,362,647 B2
(45) Date of Patent: Jun. 7, 2016

(54) CONNECTOR TERMINAL

(71) Applicant: YAZAKI CORPORATION, Tokyo (JP)

(72) Inventors: Takashi Omae, Kakegawa (JP); Hajime Kato, Kakegawa (JP); Kazuhiro Tomine, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/567,493

(22) Filed: Dec. 11, 2014

(65) Prior Publication Data

US 2015/0093944 A1 Apr. 2, 2015

Related U.S. Application Data

(63) Continuation of application No. PCT/JP2013/003645, filed on Jun. 11, 2013.

(30) Foreign Application Priority Data

Jun. 13, 2012 (JP) ..... 2012-133575

(51) Int. Cl.
*H01R 13/187* (2006.01)
*H01R 13/11* (2006.01)
*H01R 13/115* (2006.01)

(52) U.S. Cl.
CPC ..... *H01R 13/11* (2013.01); *H01R 13/113* (2013.01); *H01R 13/115* (2013.01)

(58) Field of Classification Search
CPC .... H01R 13/11; H01R 13/111; H01R 13/112; H01R 13/113; H01R 13/187; H01R 27/00; H01R 4/32
USPC ..... 439/856, 857, 845, 842, 218, 224
See application file for complete search history.

(56) References Cited

U.S. PATENT DOCUMENTS 1,200,825 A 10/1916 Fenety
3,097,906 A * 7/1963 Shannon ..... H01R 11/22 439/224

(Continued)

FOREIGN PATENT DOCUMENTS

JP 2007-531224 A 11/2007
WO 2005/096448 A1 10/2005

OTHER PUBLICATIONS

International Search Report of PCT/JP2013/003645 dated Sep. 16, 2013 [PCT/ISA/210].

(Continued)

*Primary Examiner* — Hien Vu
(74) *Attorney, Agent, or Firm* — Sughrue Mion, PLLC

(57) ABSTRACT

A connector terminal comprises: an electrical conductive portion connected with an electrical conductive member; and a connection portion integrally provided with the electrical conductive portion, the connection portion including: a pair of flat plate portions opposed to one another to form an insertion portion into which a corresponding terminal is inserted; a support portion provided in middle portions of the paired flat plate portions, the support portion restricting the paired flat plate portions from moving in directions in which they separate from one another when the corresponding terminal is inserted into the insertion portion, and a plurality of contact portions provided around the support portion in the paired flat plate portions the contact portions elastically contacting with the corresponding terminal to be electrically connected thereto.

7 Claims, 6 Drawing Sheets

(56) References Cited

U.S. PATENT DOCUMENTS 4,934,965 A * 6/1990 Buddrus ..... H01R 13/113 439/845
5,863,225 A * 1/1999 Liebich ..... H01R 13/18 439/845
7,241,189 B2 * 7/2007 Mohs ..... H01R 13/113 439/845
7,967,648 B2 * 6/2011 Byrne ..... H01R 13/113 439/856
8,360,812 B2 * 1/2013 Osvatic ..... H01R 13/055 439/819
8,827,754 B2 * 9/2014 Lee ..... H01R 13/113 439/843
2007/0066152 A1 3/2007 Mohs et al.

OTHER PUBLICATIONS

Written Opinion of PCT/JP2013/003645 dated Sep. 16, 2013 [PCT/ISA/237].
Communication dated Nov. 17, 2015 from the Japanese Patent Office in counterpart application No. 2012-133575.

* cited by examiner

CONNECTOR TERMINAL

CROSS REFERENCE TO RELATED APPLICATIONS

This application is a continuation application of International Application No. PCT/JP2013/003645, filed on Jun. 11, 2013, which claims priority to Japanese Patent Application No. 2012-133575, filed on Jun. 13, 2012, the entire contents of which are incorporated by references herein.

BACKGROUND OF THE INVENTION

1. Field of the Invention

The present invention relates to a connector terminal.

2. Description of the Related Art

Japan Patent Application Laid-Open Publication No. 2007-531224 discloses a conventional connector terminal. This connection terminal comprises a crimping extension and a socket housing integrally provided with the crimping extension. The crimping extension serves as an electrical conductive portion which is connected to an electrically conductive member. The socket housing is inserted into a corresponding terminal to be connected thereto.

A contact plate insert is housed in the socket housing of the connector terminal. The contact plate insert includes a pair of contact plate bodies and a plurality of contact plates. The contact plate bodies are formed into plate shapes, and arranged opposing to one another. The contact plates are provided in each contact plate body, and elastically contact with the corresponding terminal to be connected thereto.

Such terminal connector is provided with three insertion portions (plug openings) into which the corresponding terminal is inserted. Therefore, the corresponding terminal can be electrically connected with the connector terminal with its insertion into any of the insertion portions.

SUMMARY OF THE INVENTION

In connector terminals such as that disclosed in Patent Literature 1, when a corresponding terminal has been inserted into between the paired contact plate bodies of the contact plate insert, the socket housing restricts the paired contact plate bodies from moving in directions in which they separate from one another. The socket housing is formed into a chassis having four corners linked by link portions.

However, in the connector terminal as described above, since the four corners of the socket housing are linked by the link portions, the number of directions in which the corresponding terminal is inserted into the plug openings is limited to three.

The object of the present invention is to provide a terminal connector which can set various insertion directions of a corresponding terminal thereto.

An aspect of the present invention is a connector terminal comprising: an electrical conductive portion connected with an electrical conductive member; and a connection portion integrally provided with the electrical conductive portion. The connection portion includes: a pair of flat plate portions opposed to one another to form an insertion portion into which a corresponding terminal is inserted; a support portion provided in middle portions of the paired flat plate portions, the support portion configured to restrict the paired flat plate portions from moving in directions in which the paired flat plate portions separate from one another when the corresponding terminal is inserted into the insertion portion, and a plurality of contact portions provided around the support portion in the paired flat plate portions, the contact portions configured to elastically contact with the corresponding terminal to be electrically connected thereto.

The contact portions may have base ends located in the vicinity of the support portion, and the base ends may be continuously formed with respective flat plate portions.

The support portion may include: a fitting protruding portion protruding from one of the flat plate portions, and a fitting recess portion provided in the other of the flat plate portions to be fitted to the fitting protruding portion. The corresponding terminal may include a slit into which the fitting protruding portion is inserted.

The electrical conductive portion and the connection portion may be made of a single plate.

According to the present invention, it is possible to provide a terminal connector which can set various insertion directions of a corresponding terminal thereto.

DESCRIPTION OF THE PREFERRED EMBODIMENTS

Figure 1:
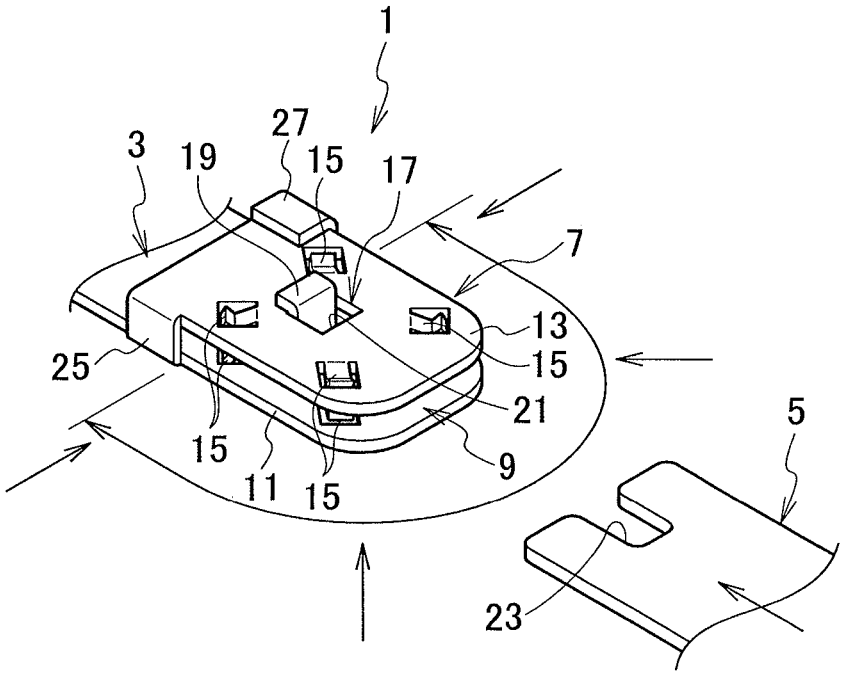
FIG. 1 is a perspective view illustrating a connector terminal according to an embodiment of the present invention.
Figure 2:
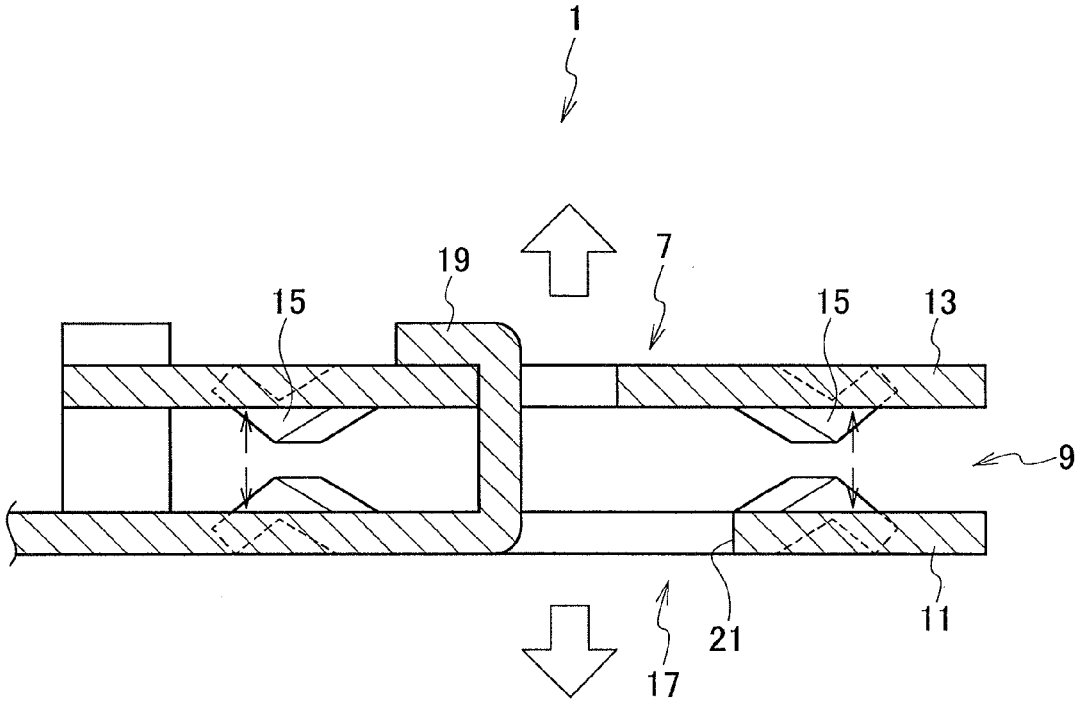
FIG. 2 is a sectional view illustrating a connector terminal according to an embodiment of the present invention.
Figure 3A:
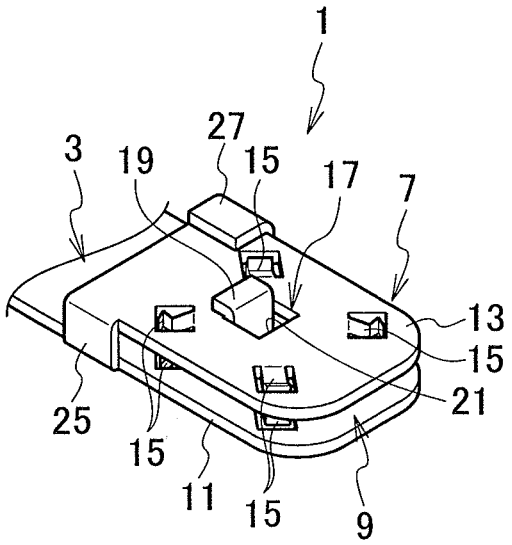
FIG. 3A is a sectional view illustrating a connector terminal according to an embodiment of the present invention.
Figure 3B:
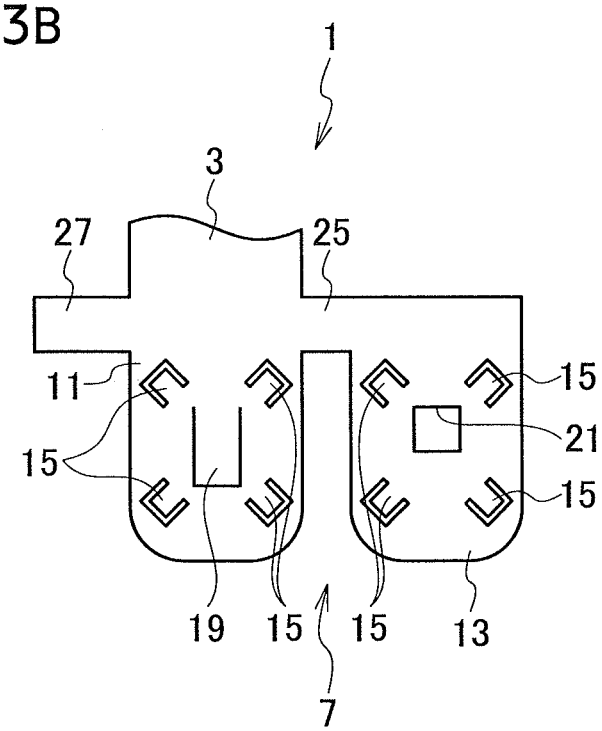
FIG. 3B is a development view illustrating a connector terminal according to an embodiment of the present invention.
Figure 4A:
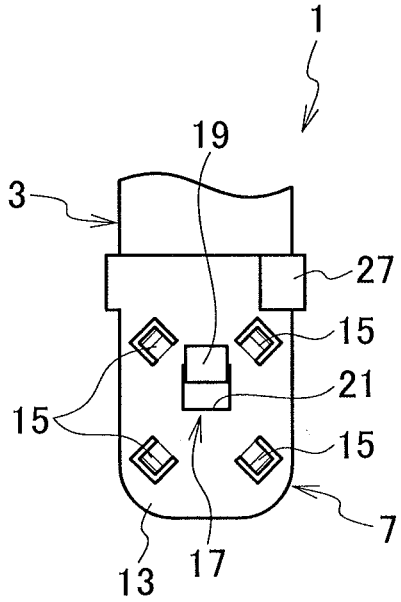
FIG. 4A is a top view illustrating a connector terminal according to an embodiment of the present invention.
Figure 4B:
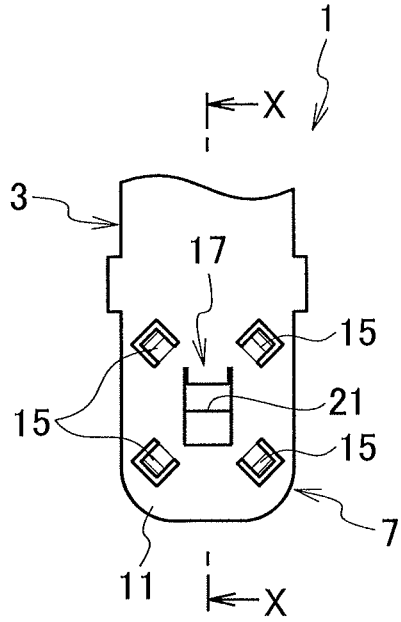
FIG. 4B is a bottom view illustrating a connector terminal according to an embodiment of the present invention.
Figure 5A:
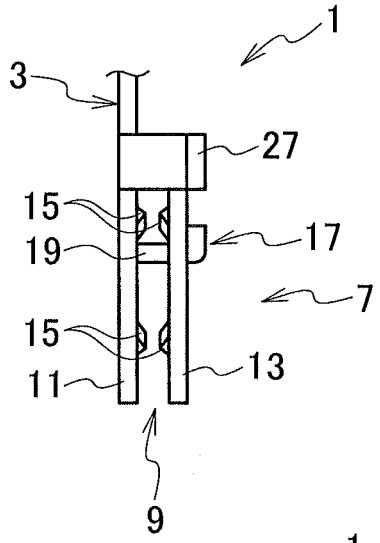
FIG. 5A is a left side view illustrating a connector terminal according to an embodiment of the present invention.
Figure 5B:
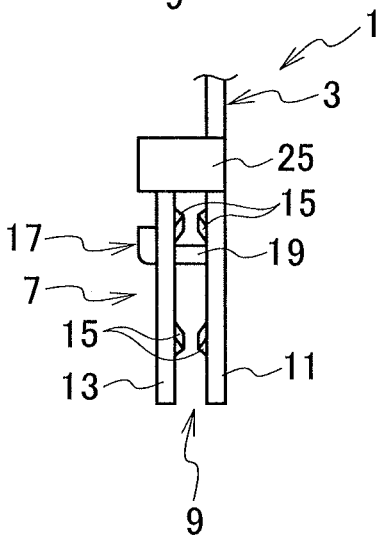
FIG. 5B is a right side view illustrating a connector terminal according to an embodiment of the present invention.
Figure 5C:
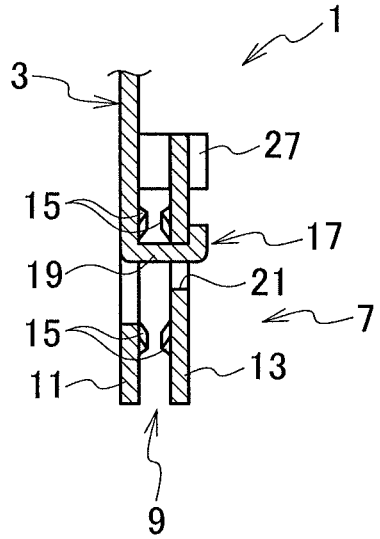
FIG. 5C is a sectional view of FIG. 4B along X-X.
Figure 6A:
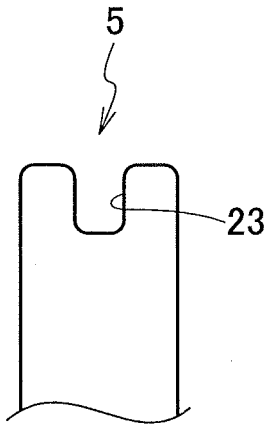
FIG. 6A is an elevation view illustrating a corresponding terminal to a connector terminal according to an embodiment of the present invention.
Figure 6B:
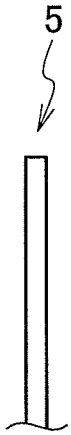
FIG. 6B is a side view illustrating a corresponding terminal to a connector terminal according to an embodiment of the present invention.

A connector terminal according to an embodiment of the present invention will be described hereinafter with reference to FIG. 1 to 6B.

The connector terminal according to the present embodiment comprises: an electrical conductive portion 3 connected with an electrical conductive member (not shown); and a connection portion into which a corresponding terminal 5 is inserted. The connection portion 7 is integrally provided with the electrical conductive portion 3.

The connection portion 7 includes: a pair of flat plate portions 11, 13 opposed to one another to form an insertion portion 9 into which the corresponding terminal 5; a support portion 17 provided in the paired flat plate portions 11, 13, the support portion 17 restricting the paired flat plate portions 11, 13 from moving in directions in which the paired flat plate portions 11, 13 separate from one another when the corresponding terminal 5 is inserted into the insertion portion 9; and a plurality of contact portions 15 provided in the paired flat plate portions 11, 13, the contact portions 15 elastically contacting with the corresponding terminal 5 to be electrically connected thereto.

The support portion 17 is provided in middle portions of the paired flat plate portions 11, 13. The contact portions 15 are provided around the support portion 17.

The contact portions 15 have base ends located in the vicinity of the support portion 17, and the base ends are continuously formed with respective flat plate portions 11, 13.

The support portion 17 includes: a fitting protruding portion 19 protruding toward the flat plate portion 13 from the flat plate portion 11, and a fitting recess portion 21 provided in the flat plate portion 13 to be fitted to the fitting protruding portion 19. Here, the fitting protruding portion 19 may be provided in the flat plate portion 13, and the fitting recess portion 21. The corresponding terminal 5 includes a slit 23 into which the fitting protruding portion 19 is inserted when the corresponding terminal 5 is inserted into the insertion portion 9.

The electrical conductive portion 3 and the connection portion 7 are made of a single plate.

As illustrated in FIGS. 1 to 6B, the connector terminal 1 is made of a single plate which is made from an electrically conductive material. The electrical conductive portion 3 and the connection portion 7 are formed by bending of the single plate.

The electrical conductive portion 3 includes an end which is connected with an electrical conductive member such as an electrical conductive portion of electronic parts, an electric wire or the like. Further, the electrical conductive portion 3 includes another end continuously connected with the connection portion 7.

The connection portion 7 includes: the pair of flat plate portions 11, 13, the plurality of contact portions 15, and the support portion 17. The paired flat plate portions 11, 13 are formed into a same shape. The paired flat plate portions 11, 13 are made of a single member, and are continuously connected to one another through a link portion 25. Specifically, the paired flat plate portions 11, 13 are opposed to one another by bending the link portion 25. The flat plate portion 11 includes an engage portion 27 formed therein. The engage portion 27 is bent and engaged with a surface of the flat plate portion 13, thereby the paired flat plate portions 11, 13 are restricted to move in directions in which they separate from one another.

Surfaces of the paired flat plate portions 11, 13, which are opposed to (face to) one another, forms an insertion portion 9 into which the corresponding terminal 5. The corresponding terminal 5 is inserted into this insertion portion 9, and is elastically contacted with a plurality of contact portions 15 provided in respective flat plate portions 11, 13, thus electrically connects with the connector terminal 1.

The contact portions 15 are provided in respective flat plate portions 11, 13. In the present embodiment, four contact portions 15 are provided in respective flat plate portions 11, 13. That is, total number of the contact portions 15 is eight. The contact portions 15 are formed by: cutting parts of the paired flat plate portions 11, 13; and bending the parts toward the insertion portion 9 side. Therefore, the contact portions 15 can elastically contact with the corresponding terminal 5. Base ends of the contact portions 15 are formed in the vicinity of the support portion 17. In other words, the base ends of the contact portions 15 located around the support portion 17, and the base ends are continuously formed with respective flat plate portions 11, 13.

As described above, the support portion 17 is provided in middle portions of the paired flat plate portions 11, 13. The support portion 17 includes: a fitting protruding portion 19 formed in the flat plate portion 11, and a fitting recess portion 21 provided in the flat plate portion 13

The fitting protruding portion 19 is formed by: cutting a middle part of the flat plate portion 11; and being the middle part toward the flat plate portion 13 side. Therefore, the fitting protruding portion 19 protrudes toward the fitting recess portion 21. The fitting protruding portion 19 is inserted into the fitting recess portion 21, and the tip end thereof is engaged with a surface of the flat plate portion 13.

The fitting recess portion 21 is a rectangular hole formed in the in middle portion of the paired flat plate portion 13. The fitting protruding portion 19 is engaged to the fitting recess portion 2, thereby the paired flat plate portions 11, 13 are restricted to move in directions in which they separate from one another when the corresponding terminal 5 is inserted into the insertion portion 9.

Since the base ends of the contact portions 15 are located around the support portion 17, a stress is likely to concentrate to the base ends and the vicinity thereof. However, the support portion 17 is located on the base end side. Therefore, stiffness around the based ends increases against the stress, thereby deformation of the paired flat plate portions 11, 13 can be prevented.

As described above, in each contact portion 15, an input (an effort) of a spring reactive force and an output (a load) thereof are located in the same position. Therefore, it is not required to disperse stresses generated by contacts between the contact portions 15 and the corresponding terminal 5, and this does not require a member to accommodate the paired flat plate portions 11, 13. In addition, even if the number of components for the connector terminal is reduced, it is possible to maintain or increase the stiffness against the spring reactive force (the stress) as describe above, thus deformation of the paired flat plate portions 11, 13 can be prevented.

Into the insertion portion 9 of the connector terminal 1 having the aforementioned structure, the corresponding terminal 5 with a male type having a tab-shaped connection portion is inserted. As illustrated in FIG. 1, the corresponding terminal 5 can be inserted into the insertion portion 9 from any positions within 180 degrees except of the electrical conductive portion 3 side, as indicated by arrows. The corresponding terminal 5 includes the slit 23 into which the fitting protruding portion 19 of the support portion 17 when the corresponding terminal 5 is inserted into the insertion portion 9. Accordingly, mechanical interference between the corresponding terminal 5 and fitting protruding portion 19 can be avoided in the insertion of the corresponding terminal 5 into the insertion portion 9 from any positions (any directions). Consequently, it is possible to insert the corresponding terminal 5 into a deep position of the insertion portion 9.

As described above, the support portion 17 is provided in the middle of the paired flat plate portion 11, 13. Therefore, when only the support portion 17 supports the paired flat plate portions 11, 13, the link portion 25 and the engage portion 27 can be omitted. In this case, it is possible to insert the corresponding terminal 5 into the insertion portion 9 from all positions within 360 degrees.

In the connector terminal 1 as describe above, the support portion 17 is provided in the middle of the paired flat plate portions 11, 13, and the contact portions 15 are provided around the support portion 17. Therefore, the insertion portion 9, which is formed by the mutually opposed surfaces of the paired flat plate portions 11, 13, is positioned toward all directions, and it is possible to electrically connect the corresponding terminal 5 with the connector terminal 1 by the insertion from any directions.

The connector terminal 1 as described above does not limit the insertion direction of the corresponding terminal 5 into the insertion portion 9. In other words, it is possible to set the insertion direction to various (multiple) directions, and the insertion direction the corresponding terminal 5 can continuously vary within the aforementioned angular range.

The contact portions 15 have base ends located in the vicinity of the support portion 17, and the base ends are continuously formed with respective flat plate portions 11, 13. The support portion 17 can receive stresses generated by contacts between the contact portions 15 and the corresponding terminal 5. Accordingly, deformation of the paired flat plate portions 11, 13 can be prevented, and the contact reliability can be improved.

Further, the corresponding terminal 5 includes the slit 23 into which the fitting protruding portion 19 is inserted when the corresponding terminal 5 is inserted into the insertion portion 9. Therefore, the mechanical interference between the corresponding terminal 5 and fitting protruding portion 19 in the insertion portion 9 can be avoided, and it is possible to insert the corresponding terminal 5 into a deep position of the insertion portion 9. This can improve the electrical connection reliability between the corresponding terminal 5 and the connector terminal 1.

The electrical conductive portion 3 and the connection portion 7 are made of a single plate. There is no requirement to prepare the electrical conductive portion 3 and the connection portion 7 individually. Accordingly, the number of parts for the connector terminal can be reduced.

In the terminal connector according to the present embodiment, the electrical conductive portion and the paired flat plate portions are made of a single member so as to continuously connect therewith. However, the present invention is not limited to this embodiment. For example, the electrical conductive portion and the paired flat plate portions may be individually formed as separated bodies, and the electrical conductive portion may include an accommodation member (or part) to accommodate the paired flat plate portions. For example, the accommodation member is formed of two plates that accommodate the paired flat plate portions therebetween.

As same as the above embodiment, in this case, the paired flat plate portions is restricted to move in directions in which they separate from one another. Accordingly, the two plates of the accommodation member can be linked only by at most two pillars provided at their corners. The two pillars can be located not to interfere the insertion of the corresponding terminal into the insertion portion from any directions within 180 degrees. In other words, the corresponding terminal can be inserted into the insertion portion from any positions within 180 degrees.

In the present embodiment, four contact portions are provided in each flat plate portion. In the present invention, the number of the contact portions is not limited to four. Specifically, as far as the contact portions are provided around the support portions, the number thereof may be more than or less than four.

What is claimed is:

1. A connector terminal comprising:

an electrical conductive portion connected with an electrical conductive member; and a connection portion integrally provided with the electrical conductive portion, the connection portion including:

a pair of flat plate portions opposed to one another to form an insertion portion into which a corresponding terminal is inserted therein;

a support portion extending upward from one flat plate portion to a fitting recess portion of an opposite flat plate portion to restrict the pair of flat plate portions from moving in a first direction in which the pair of flat plate portions separate from one another when the corresponding terminal is inserted into the insertion portion between the pair of flat plate portion, the support portion being centrally disposed in the pair of flat plate portions and having a first flat section in a second direction corresponding to a direction of insertion of the corresponding terminal and a second section in a third direction perpendicular to the second direction, and a plurality of contact portions provided around the support portion in the pair of flat plate portions, the contact portions configured to elastically contact with the corresponding terminal to be electrically connected thereto, wherein the insertion portion opens from between the pair of flat plate portions and continuously opens around the support portion except on a side end between the pair of flat plate portions where the electrical conductive portion is connected.

2. The connector terminal according to claim 1, wherein the contact portions have base ends located in the vicinity of the support portion, and the base ends are continuously formed with respective flat plate portions.

3. The connector terminal according to claim 1, wherein the support portion includes a fitting protruding portion protruding from one of the flat plate portions, and the fitting recess portion provided in the other of the flat plate portions to be fitted to the fitting protruding portion, and wherein the corresponding terminal includes a slit configured to accept the fitting protruding portion.

4. The connector terminal according to claim 1, wherein the electrical conductive portion and the connection portion are made of a single plate.

5. The connector terminal according to claim 1, wherein the support portion is integral with one of the pair of flat plate portions and protrudes through a fitting recess in an other of the pair of flat plate portions.

6. The connector terminal according to claim 1, wherein a first edge, on a side opposite to the electrical conductive member, of one of the pair of flat plate portions is not directly connected to a second edge, on the side opposite to the electrical conductive member, of an other of the pair of flat plate portions.

7. The connector terminal according to claim 1, wherein the plurality of contact portions includes a first pair of contact portions respectively disposed on opposite sides of the support portion and a second pair of contact portions disposed on opposite sides of the support portion and offset from the first pair of contact portion by 90 degrees.

* * * * *